US005584459A

United States Patent [19]

Meyer

[11] Patent Number: 5,584,459

[45] Date of Patent: Dec. 17, 1996

[54] BRACKET SYSTEM FOR HANGING WINDOW COVER FRAME

[76] Inventor: George Meyer, 20909, R.R. #1, Alton, Ontario, Canada, L0N 1A0

[21] Appl. No.: 418,167

[22] Filed: Mar. 13, 1995

[51] Int. Cl.[6] ..... A47H 1/14

[52] U.S. Cl. ..... 248/251; 160/902

[58] Field of Search ..... 248/251, 252, 248/254, 261, 264, 266, 267, 268, 273, 48.2, 48.1; 160/38, 39, 178.1 V, 902, 900

[56] References Cited

U.S. PATENT DOCUMENTS

| | | | |
|---|---|---|---|
| 4,079,770 | 3/1978 | Woodle | 160/39 X |
| 4,607,818 | 8/1986 | Georgopoulos | 248/251 X |
| 4,662,421 | 5/1987 | Basmadji et al. | 160/39 X |
| 5,012,850 | 5/1991 | Schrader | 160/902 X |

*Primary Examiner*—Ramon O. Ramirez

[57] ABSTRACT

A bracket system used in suspending a window cover frame comprises first and second bracket members. The first bracket member has a main body portion made from a rigid high strength material for mounting to a support surface for the bracket system and for holding the second bracket member. The first bracket member has a connector to releasably secure the first and second bracket members to one another. The connector is pressed from the material of the main body portion of the first bracket member in the form of a pair of wings. Each wing comprises a base part which remains attached to the first bracket member and an outer part spaced by a gap from and being generally parallel with the main body portion. The outer parts of the wings face away from another. The connector has a length which spans both of the outer parts of the wings and a width which is less than the length of the connector. The second bracket member has an opening with a length greater and a width less than the length of the connector. The width of the opening is at least slightly greater than the width of the connector. The connector is fittable through the opening on the second bracket member to an insertion position when the connector and the opening are aligned length to length with another and the second bracket member is twistable to a locking position where it fits into each gap and is locked between each of the outer parts of the connector and the main body portion of the first bracket member.

1 Claim, 2 Drawing Sheets

FIG. 1.
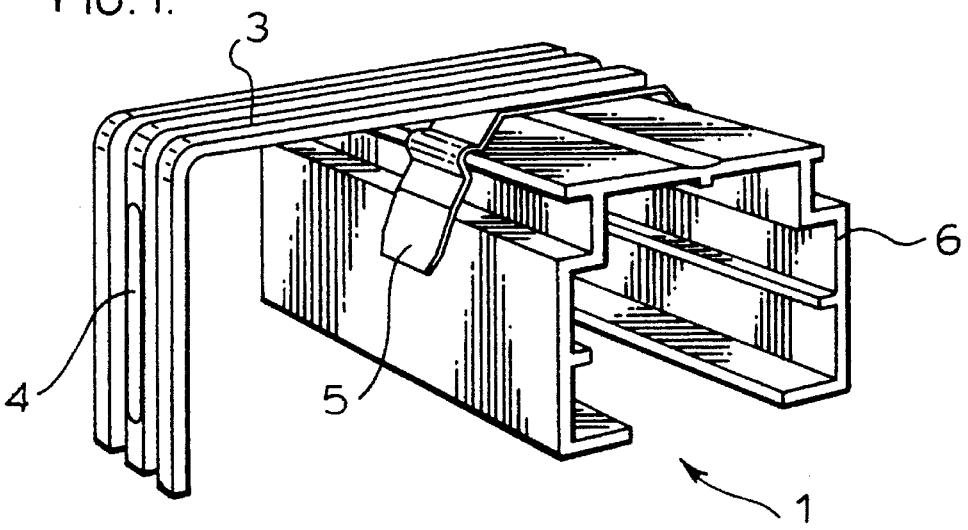
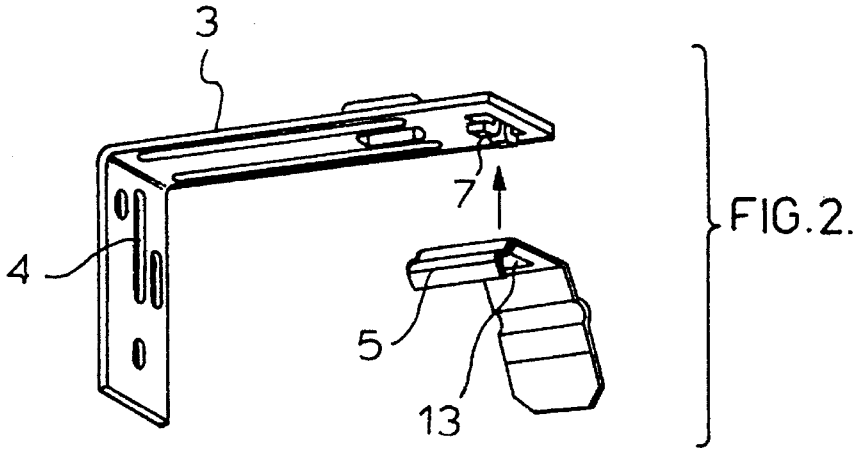
FIG. 2.
FIG. 3.
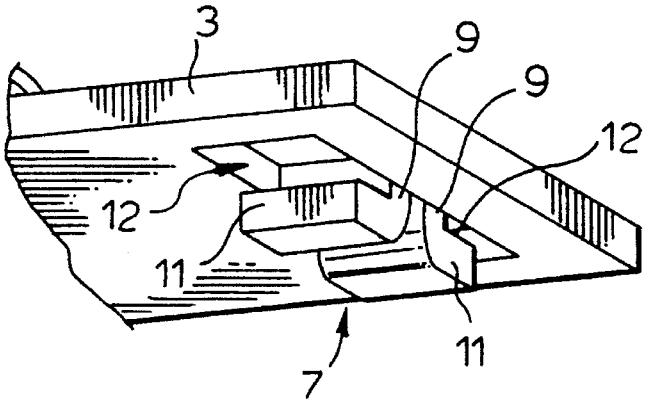

BRACKET SYSTEM FOR HANGING WINDOW COVER FRAME

FIELD OF THE INVENTION

The present invention relates to a bracket system used in suspending a window cover frame. The bracket system includes first and second bracket members releasably secured to one another by a connector formed directly from the material in the first bracket member.

BACKGROUND OF THE INVENTION

There are currently available many different types of bracket arrangements used for hanging window cover frames, i.e. frames which support vertical blinds and the like. Many of these bracket arrangements are in the form of a main bracket portion which is affixed to a supporting roof or wall structure and a more flexible spring clip secured to the main bracket portion. The upper header or frame of the window cover is releasably held by the spring clip.

The fastening of the spring clip in the main bracket portion may be of a permanent nature secured by rivets and the like. In the alternative, the two bracket components can be releasably secured to one another in which case a connector member is provided on the main bracket portion for releasably receiving the clip. According to known construction, the connector member is the form of an add on piece to the main bracket portion. This necessitates both modifications to the main bracket portion to receive the connector member and the actual steps of fitting the connector member to the bracket after it has been modified. All of this is very labour intensive and the bracket system must rely on a very positive fastening of the connector member to the main bracket portion to ensure that there is no failure between the clip and the main bracket portion.

SUMMARY OF THE INVENTION

The present invention provides a bracket system used in suspending a window cover frame which overcomes the drawbacks noted above. In particular, the bracket system of the present invention comprises first and second bracket members in which the first bracket member has a main body portion made from a rigid high strength material for mounting to a support for the bracket system and for holding the second bracket member. The first bracket member has a connector formed directly from the first bracket member which releasably secures the first and second bracket members to one another. The connector is pressed from the rigid high strength material out of the main body portion of the first bracket member as a pair of wings. Each wing comprises a base pan which remains attached to the first bracket member and an outer pan spaced by a gap from and being generally parallel with the main body portion. The outer parts of the wings face away from one another with the connector having a length which spans both of the wings and a width which is less than its length.

The second bracket member has an opening with a length greater than and a width less than the length of the connector. The width of the opening is at least slightly greater than the width of the connector. The connector on the first bracket member is fittable through the opening in the second bracket member to an insertion position when the connector and opening are aligned length to length with one another and the second bracket member is twistable to a locking position in which the second bracket member fits into each gap locked between each of the outer parts of the connector and the main body portion of the first bracket member.

The essence of the overall system resides in the fact that the connector is pressed directly from the material of the first bracket member which eliminates the requirement for having to add a separate connector piece to the system.

BRIEF DESCRIPTION OF THE DRAWINGS

The above as well as other advantages and features of the present invention will be described in greater detail according to the preferred embodiments of the present invention in which:

FIG. 1 is a perspective view of a bracket system supporting a window cover frame according to a preferred embodiment of the present invention;

FIG. 2 is an exploded perspective view of the bracket system of FIG. 1;

FIG. 3 is an enlarged perspective view of the connector member from the main bracket member of the system of FIG. 2;

Figure 4:
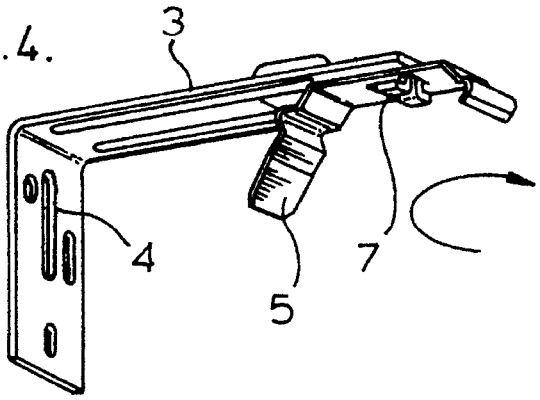
FIG. 4 shows the bracket system of FIG. 2 with the two bracket members secured to one another.
Figure 5:
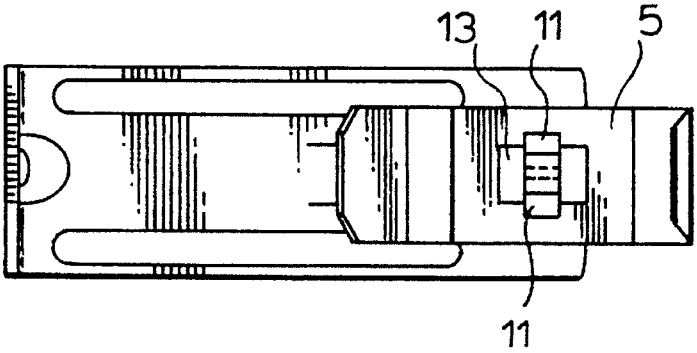
FIG. 5 is a bottom view of the bracket system of FIG. 4.

DETAILED DESCRIPTION ACCORDING TO THE PREFERRED EMBODIMENTS OF THE PRESENT INVENTION

FIG. 1 shows a bracket system generally indicated at 1. This bracket system comprises a first or main bracket member 3 which is made from a rigid high strength material such as steel plate or a high strength aluminum etc. Bracket member 3 includes a slot 4 through which a mounting screw can be fitted for securing the bracket to a supporting wall or the like.

A second bracket member in the form of a spring clip 5 is releasably secured to the first bracket member by means of a connector 7. The spring clip is used to snap on to a header or frame 6 which in turn supports a window cover such as a vertical blind or the like.

The key feature to the present invention resides in the formation of connector 7 which is best seen in FIG. 3 of the drawings. This connector comprises a pair of wings which are formed directly from the rigid material of the main body of bracket member 3. Each of these wing members is initially cut and then pressed out of the main body leaving a base pan 9 which remains connected to the bracket member and an outer part 11 which is spaced by a gap 12 from the main body portion of bracket member 3. As is clearly seen in FIG. 3 of the drawings, the outer pans 11 of the wings face in opposite directions from one another generally parallel to the main body portion of the bracket member 3.

Connector 7 has a length which spans both of the outer pans 11 of the wings and a width which is equal to the distance from side to side across an individual wing. Accordingly, the overall length of the connector member is substantially greater than its width.

Spring clip 5 is provided with an elongated rectangular opening 13. This opening has a length which is slightly greater than and a width which is less than the length of the connector 7 on bracket member 3. In addition, the width of the opening 13 is slightly greater than the width of the connector.

As a result of the above dimensioning, connector 7 of bracket member 3 is fittable through the opening 13 of clip 5 when the bracket and clip are in the FIG. 2 position, i.e. when the connector and opening are running length to length with one another. From here the clip is twistable to the FIG. 4 position where the clip is positively secured in the gap between each of the outer parts of the two wings and the main body portion of the bracket member 3.

The outer parts of the two wings are pressed out of the main body portion of bracket member 3 by a distance which is only slightly greater than the thickness of the material in clip 5 so that the clip is wedged tightly between the connector and the main bracket member. This interference fit will not change over time and allows the clip and the bracket member to be released and re-secured to one another in a very position manner as many times as is necessary. Furthermore, the accuracy of the fit is easily guaranteed through a very simple and efficient connector forming method.

Figure 6:
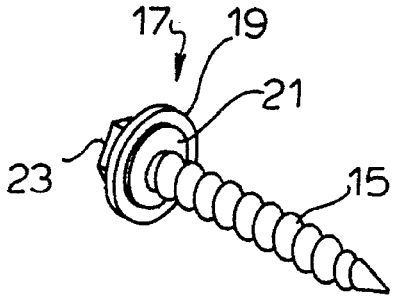
FIG. 6 is a bottom perspective view of a screw fittable with the spring clip from the bracket system of FIG. 4.
Figure 7:
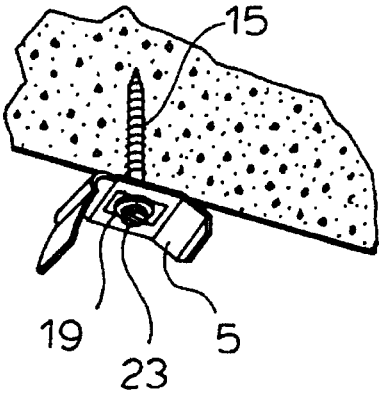
FIG. 7 is a perspective view of the screw of FIG. 6 fitted with the spring clip.

FIG. 6 of the drawings shows a screw 15 specifically designed for use with clip 5 where the clip itself is to be secured directly to a mounting surface without the use of bracket member 3. The screw 15 has a head generally indicated at 17 which comprises a main collar 19 and a secondary collar 21 on the threaded side of the main collar. Provided on the opposite side of the main collar is an outer head portion 23 provided with a screw driver receiving slot for threading the screw into the supporting surface.

As is clearly shown in FIG. 6, the secondary collar 21 has a smaller diameter than the main collar 19. The actual size of the secondary collar is dimensioned such that it fits tightly within the width of opening 13 whereas the main collar 19 is greater than the width of the opening. Accordingly, when the screw is threaded into the supporting surface, the secondary collar fits snuggly into the opening to prevent the spring clip from shifting relative to the screw while the main collar 19 provides the actual fastening of the clip to the mounting surface.

Although various preferred embodiments of the invention have been described in detail, it will be appreciated by those skilled in the art, that variations may be made without departing from the spirit of the invention or the scope of the appended claims.

The embodiments of the invention in which an exclusive property or priviledge is claimed are defined as follows:

1. A bracket system used in suspending a window cover frame, said system comprising first and second bracket members, said first bracket member having a main body portion made from a rigid, high strength material for mounting to a support for said bracket system and for holding said second bracket member, said first bracket member having a connector formed therefrom which releasably secures said first and second bracket members to one another, said connector being pressed from said rigid, high strength material out of said main body portion of said first bracket member as a pair of wings, each wing comprising a base part which remains attached to said first bracket member and an outer part spaced by a gap from and being generally parallel with said main body portion of said first bracket member, said outer parts of said wings facing away from one another, said connector having a length which spans both of said wings and a width which is less than the length of the connector, said second bracket member having an opening with a length greater and a width less than the length of said connector; the width of said opening being at least slightly greater than the width of said connector, said connector being fittable through said opening to an insertion position when said connector and said opening are aligned length to length with one another and said second bracket member being twistable to a locking position in which said second bracket member fits into each gap locked between each of the outer parts of said connector and said main body portion of said first bracket member.

* * * * *